United States Patent [19]

Hennemann

[11] 4,165,453

[45] Aug. 21, 1979

[54] SWITCH WITH DEVICE TO INTERLOCK THE SWITCH CONTROL IF THE CONTACTS STICK

[75] Inventor: Jean Hennemann, Homblieres, France

[73] Assignee: Societe Anonyme dite: UNELEC, Paris, France

[21] Appl. No.: 820,026

[22] Filed: Jul. 28, 1977

[30] Foreign Application Priority Data

Aug. 9, 1976 [FR] France ..... 76 24276

[51] Int. Cl.[2] ..... H01H 3/00; H01H 25/00; H01H 21/04

[52] U.S. Cl. ..... 200/153 G; 335/166; 200/337; 200/67 B

[58] Field of Search ..... 200/153 G, 244, 318, 200/322, 323, 324, 337, 67 B; 335/191, 166; 337/59, 70, 71

[56] References Cited

U.S. PATENT DOCUMENTS

| | | | |
|---|---|---|---|
| 3,605,052 | 9/1971 | Dimond et al. | 335/166 |
| 3,614,685 | 10/1971 | Ellsworth et al. | 335/166 |
| 3,783,215 | 1/1974 | Brumfield | 200/153 G |
| 3,849,747 | 11/1974 | Mrenna et al. | 355/166 |

FOREIGN PATENT DOCUMENTS 2262859 9/1975 France .

*Primary Examiner*—Steven M. Pollard
*Attorney, Agent, or Firm*—Haseltine, Lake & Waters

[57] ABSTRACT

A switch in which if the contacts of the switch are lightly stuck together the switch control can still separate them, but if the contacts are firmly stuck together then the switch control cannot be moved to the "off" position which would give a dangerously erroneous indication of the state of the circuit switched. A two arm locking lever is pivotally mounted and has a first stop constituted by a spring into which one of the arms penetrates, and a second stop constituted by a pivot axis of the device.

5 Claims, 3 Drawing Figures

SWITCH WITH DEVICE TO INTERLOCK THE SWITCH CONTROL IF THE CONTACTS STICK

FIELD OF THE INVENTION

This invention relates to switches, and in particular low voltage switches in moulded casings. Switches of this type comprise, in each pole, a moving contact working in conjunction with a fixed contact to open or close the electrical circuit controlled by the switch. The moving contacts are associated with a mechanism fitted with a switch control enabling the aforesaid contacts to be opened and closed, the position of the switch control indicating the corresponding open or closed condition of the switch.

For the safety of the user, when the switch control indicates that the switch is in the open position, the contacts of all the poles must in actual fact be open. Now, under certain exceptional operating conditions of the switches, it happens that the moving contacts remain stuck on the fixed contacts with an adhesive force such that the mechanism is not strong enough to break the joint. In such an exceptional circumstance, it is therefore necessary that the switch control indicate the closed position of the switch and even that the user be prevented from intentionally moving the switch control to a position which would indicate incorrectly that the switch is open.

PRIOR ART

Switches are known in which the control mechanism has been especially designed to provide this safety for the user but these mechanisms require precise relationships between the different links of the moving parts of the switch and because of this are difficult to adapt to the majority of existing switches.

Devices are also known which provide this safety feature by adding to the switch a switch control interlock mechanism the aforesaid mechanism inserting a stop in the path of the switch control so long as the contacts ae not open.

These interlock mechanisms also require special arrangements to ensure that the switch control is not interlocked before the contacts have been opened in the normal way by the control mechanism. Because of this, these devices are difficult to implement and cannot always be incorporated in the smaller size switches.

SUMMARY OF THE INVENTION

The present invention solves these problems. In the switch with a device to interlock the switch control if the contacts stick according to the invention, particularly simple means, adaptable to the majority of switch control mechanisms, establish a mechanical link, during the contact opening movement, between the switch control and an arm driving the moving contacts of the switch, the aforesaid link locking the switch control before it reaches its open position if the moving contacts of the switch remain stuck.

The present invention comtemplates to a switch comprising:

an operating arm rigidly attached to the switch control, able to move between a closed position and an open position, moving contacts working in conjunction with fixed contacts to open or close an electrical circuit, the aforesaid moving contacts being fitted on a drive arm able to move between a closed position and an open position, an automatic trip lever which can be latched in an engaged position, a quick acting mechanism comprising a spring and a connecting rod assembly articulated between the moving contact drive arm and the automatic trip lever, a device to interlock the switch control if the contacts stick, comprising a locking lever controlled by a stop linked to the operating arm and resting on a second stop, linked to the moving contact drive arm when this arm is not in the open position, the aforesaid locking lever consisting of two arms pivoting about one pin of the aforesaid connecting rod assembly.

BRIEF DESCRIPTION OF THE DRAWING

Other features and advantages of the invention will be better understood from the following description of one non-limiting embodiment read in association with the drawing in which.

DETAILED DESCRIPTION

Figure 1:
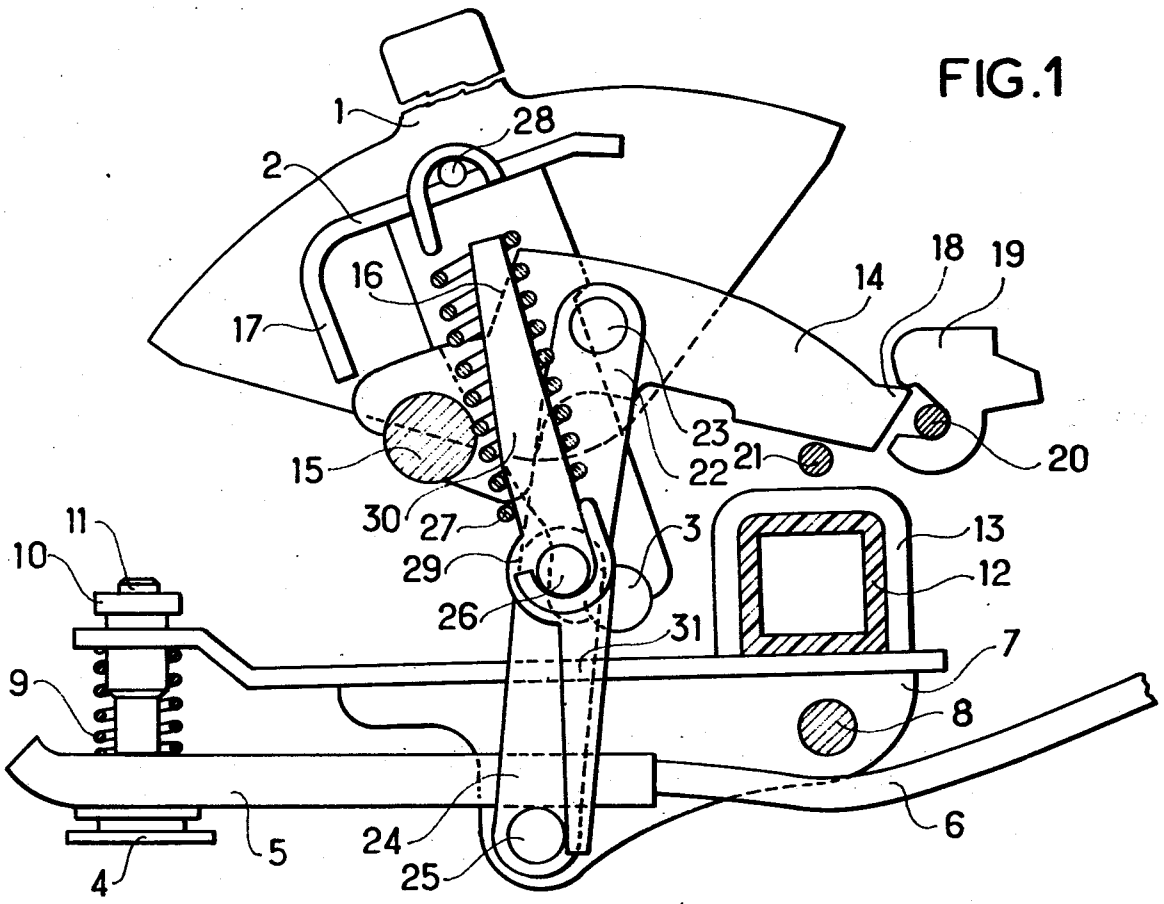
FIG. 1 shows a partial section of the switch according to the invention, shown in the closed position.
Figure 2:
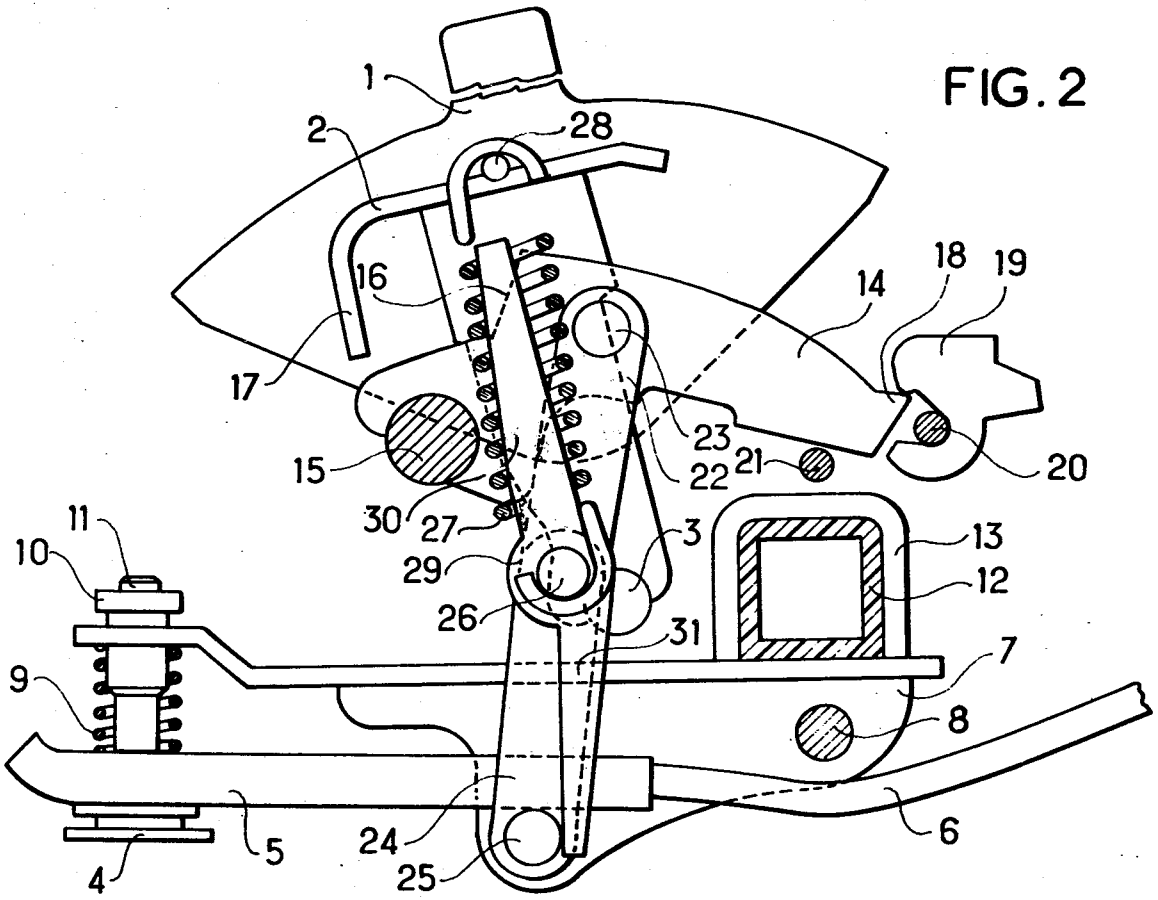
FIG. 2 shows a partial section of the same switch shown in the process of opening.
Figure 3:
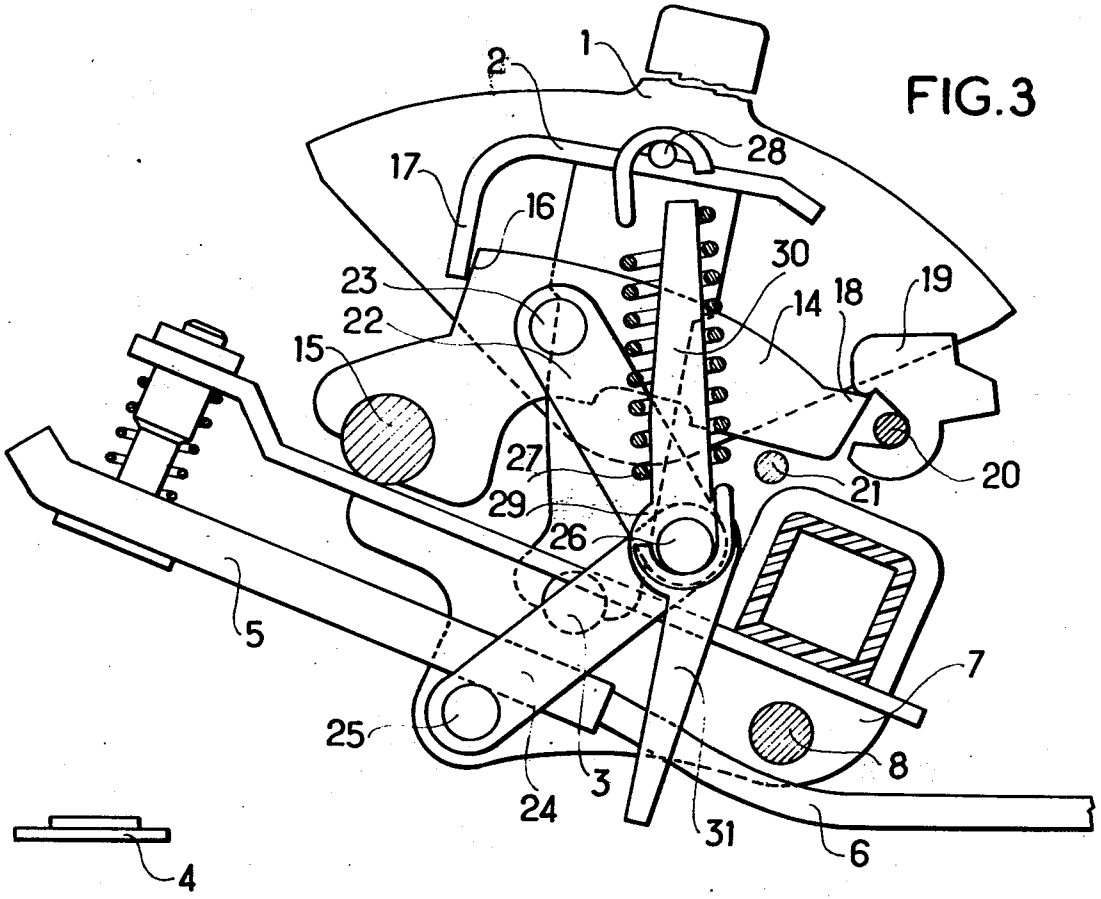
FIG. 3 shows a partial section of the same switch, shown in the open position.

Referring to FIGS. 1, 2 and 3, the switch comprises an insulating casing and a cover which are not shown, inside which are arranged the active parts of the switch. A switch control 1 passes through an opening in the cover and is rigidly attached to an operating arm 2 articulated about fixed pivots 3.

On the casing is mounted the fixed contact 4 working in conjunction with a moving contact 5 to open or close the electrical circuit controlled by the switch. The moving contact 5 is connected to a lead 6 and is loose mounted on a drive arm 7 itself pivoting about a fixed pin 8. A spring 9 arranged between the drive arm 7 and the moving contact 5 provides the contact force in the closed position while a nut 10 engaged in a slot in the drive arm 7 and screwed onto a threaded rod 11 forming an integral part of the moving contact 5 enables the clearance between the moving contact 5 and the drive arm 7 in the open position to be adjusted. A small insulating bar 12 attached by a clip 13 to the drive arm 7 provides a rigid link with similar drive arms fitted in each of the poles of the switch.

An automatic trip lever 14 is rigidly fixed to a pin 15 pivoting the fixed bearings which are not shown. The lever 14 has a reset mounting 16 on which an extension 17 of the operating arm 2 can rest. The lever 14 can be held in the engaged position by a catch 18 with a bolt 19 pivoting about a fixed pin 20. The bolt 19 is actuated by an automatic trip device which is not shown. A stop 21 limits the downward travel of the trip lever 14. Between the automatic trip lever 14 and the drive arm 7 is articulated a quick acting connecting rod mechanism comprising one set of rods 22 pivoting about a pin 23 held by the automatic trip lever 14 and a second set of rods 24 pivoting about a pin 25 held by the drive arm 7. The sets of rods 22 and 24 form a knuckle joint articulating about a common pin 26. Between the pin 26 of the knuckle joint and the operating arm 2 is stretched a quick acting spring 27 one end of which is linked to the pin 26 and the other end of which is linked to an attachment 28 carried by the operating arm 2.

According to the invention, a two arm lever 29 with arms 30 and 31 pivots about the pin 26. The arm 30 is mounted inside the spiral part of the spring 27 and extends from the pin 26 of the knuckle joint to a position close to the attachment 28 carried by the operating arm 2. The arm 31 extends from the pin 26 of the knuckle joint to a pisition level with the pin 25 held by the drive arm 7.

The operation of the switch control interlock device will now be explained, still with reference to FIGS. 1, 2 and 3.

FIG. 1 shows the switch in the closed position. The trip lever 14 is engaged in its catch 18 under the bolt 19 and the switch control 1 is in the closed position. The spring 27, stretched between the attachment 28 held by the operating arm 2 and the pin 26 of the connecting rod assembly 22, 24 holds the operating arm fast against the pin 15 and set of rods 22 resting against a stop which is not shown. The connecting rod assembly 22, 24 is thus in the extended position, representing the closed position of the drive arm 7 and the moving contact 5 pressed against the fixed contact 4 by the force of the spring 9. The moving contact 5 is also resting on the pin 25 held by the drive arm 7. The position of the lever 29 is determined by that of the spring 27, the arm 30 of the lever 29 being engaged in the spiral part of the spring 27. As can be seen from the figure, the play between the lower part of the arm 30 and the inside of the spring 27 is very little. On the other hand, the play between the upper part of the arm 30 and the inside of the spring 27 is relatively greater. This provides a certain clearance between the end of the arm 30 and the end of the spring 27 fixed to the attachment 28.

As shown in FIG. 1, the arm 31 of the lever 29 is resting on the pin 25 held by the drive arm 7. Obviously this is not necessary for the operation of the switch in the closed position and a certain amount of play between the arm 31 and the pin 25 is possible without in any way damaging the correct operation of the device. To open the switch manually from the closed position in FIG. 1, the switch control 1 is moved to the right, thus turning the operating arm 2 clockwise about the pivots 3. The point of attachment 28 of the spring 27 thus moves together with the operating arm 2 and the switch control 1 whilst the other parts of the mechanism remain stationary until the position shown in FIG. 2 is reached. In this new position the inside of the spiral of the spring 27 has come to rest in the direction of opening along the arm 30 of the lever 29.

Continuing the rightward movement of the switch control 1, the point of attachment 28 of the spring 27 continues to move. In addition, the arm 31 of the lever 29 comes to rest on the pin 25 and as the arm 30 of the lever 29 is driven in the direction of opening with the operating arm 2 by the inside of the spring 27, the movement of the switch control compels the pin 26 also to move to the right altering the angle formed by the knuckle joint connecting rod assembly 22, 24. When the point of attachment 28 of the spring 27 passes the dead centre position of the set of rods 22 in which the attachment 28 is aligned with the articulation pins 23 and 26, the force exerted by the spring 27 on the pin 26 swings the set of rods 22 about the pin 23 in an anticlockwise direction.

If the contacts are not stuck, the force exerted by the spring 27 on the pin 26 is then adequate to open the switch fully by breaking the connecting rod assembly 22, 24 to a position in which the drive arm 7 comes to rest against the pin 15 (FIG. 3). Note that in this position, the line of action 26, 28 of the spring 27 is on the other side of the pivots 3 and consequently the operating arm 2 is held fast by its extension 17 against the reset mounting 16 of the automatic trip lever 14 under the force of the spring 27. The switch control 1 is thus held in the open position with the operating arm 2 even if the switch control is released. If on the other hand, the contacts are stuck, all movement of the pin 25 is prevented by the moving contact 5 and the drive arm 7 remains in the closed position. The force exerted on the switch control 1 is then transmitted to the pin 26 by the lever 29, the arm 31 of which is resting on the pin 25. This force tends to break the connecting rod assembly 22, 24 but after taking up the play in the linkage, the movement is blocked if the contacts remain stuck because the pins 23 and 25 can no longer move and form an unbreakable triangle with the pin 26. The movement of the switch control 1 is then blocked before it has been able to reached the open position, thus indicating clearly to the operator that the contacts are stuck. In addition, if the switch control is released, it automatically returns to the closed position under the force of the spring 27.

It is to be noted that the device is still effective even if the automatic trip device operates, ie. when the bolt 19 has released the trip lever 14. In this case, if the contacts are stuck, the counterclockwise movement of the lever 14 about its pin 15 under the force of the spring 27 transmitted to the pin 23 by the set of rods 22, remains limited to the range of movement of the pin 26 linked to the pin 25 by the set of rods 24. The simple result is that the connecting rod assembly 22, 24 will scarcely change its position from the closed position shown in FIG. 1, so that if the switch control 1 is moved in the open direction, the switch will pass more or less through the same positions as those previously described if the contacts are stuck. In addition, the opening force exerted on the switch control 1 and transmitted to the pin 26 to break the connecting rod assembly 22, 24 will cause the automatic trip lever 14 to come to rest against the stop 21 which establishes the same conditions inhibiting movement of the switch control as before.

It will easily be understood that the different parts shown on the drawing are not located in the same plane and that the device has been so designed that the paths of the different parts do not interfere with each other. Thus, for example, the operating arm 2 is in the shape of an inverted U, the legs of which are arranged on either side of the mechanism, each leg being articulated about a pivot 3. Similarly, it is advantageous to arrange a spring 27 and a lever 29 articulated about the pin 26 on either side of the set of rods 22, so that the springs 27 and the arms 30 of the levers 29 can pass freely to each end of the pin 23, at the same time providing suitable distribution of the forces exerted at the points of articulation. It will also be understood that, because of the rigid mechanical link between the drive arms of each pole provided by the small insulating bar 12, the contacts of all the poles open simultaneously and only one contact need remain stuck to prevent the switch control being moved to the open position.

Of course, without departing from the scope of the invention, versions of the switch with a device to interlock the switch control if the contacts stick can be constructed other than that described previously which is given as an example of one embodiment and is in no way limitative, provided that these versions satisfy the general specification of the invention which has been given.

In particular, the lever 29 may pivot about a pin of the connecting rod assembly 22, 24 other than the pin 26 if it exerts the force of the spring 27.

Similarly, during the opening movement, the arm 30 of the lever 29 can be driven by parts linked to the operating arm 2 other than the inside of the spiral of the spring 27 fixed to the attachment 28. Thus, for example, the end of the arm 30 can be arranged with a certain amount of clearance between two stop held by the operating arm 2.

Similarly, too, during the opening movement, if the contacts are stuck, the arm 31 of the lever 29 can come to rest on parts to the drive arm 7 other than the pin 25 linking the set of rods 24 to the drive arm 7. Thus, for example, the end of the arm 31 can rest on the lug forming part of the drive arm 7. Or the end of the arm 31 can be fitted with a lug which would rest on the set of rods 24.

Thus, the present invention can be applied to many types of switches with quick acting mechanisms other than that described previously; it is simply necessary to choose a suitable pin of articulation of the lever 29 and the position of the stops linked respectively to the operating arm 2 and the moving contact drive arm 7 in order to lock the switch control 1 if the contacts remain stuck.

What is claimed is:

1. A switch comprising:

an operating arm rigidly attached to a switch control, and able to move between a closed position and an open position, moving contacts working in conjunction with fixed contacts to open or close an electrical circuit, said moving contacts being fitted on a drive arm able to move between a closed position and an open position, an automatic trip lever which can be latched in an engaged position, a quick-acting mechanism comprising a spring and a knuckle joint connecting rod assembly articulated between the moving contact drive arm and the automatic trip lever, said connecting rod assembly comprising a central link pin to which one end of said spring is coupled, means for interlocking the switch control if the contacts stick, comprising a locking lever controlled by a stop linked to the operating arm and resting on a second stop, linked to the moving contact drive arm when this arm is not in the open position, said locking lever consisting of a two-arm lever having two arms pivoting about said central link pin of said connecting rod assembly.

2. A switch according to claim 1 in which one of the arms of the two-arm lever is fitted inside the said spring of the mechanism, one end of which is coupled to the central link pin of said connecting rod assembly.

3. A switch according to claim 2, in which the said stop linked to the operating arm embodies the inner surface of the said spring, the other end of which is coupled to the said operating arm rigidly connected to the switch control.

4. A switch according to claim 1, in which the said second stop linked to the moving contact drive arm consists of a pin linking the said drive piece with the articulated connecting rod assembly.

5. A switch according to claim 1, in which the said second stop linked to the moving contact drive arm consists of a pin linking the said moving contacts with the said drive arm.

* * * * *